United States Patent [19]

Turner

[11] 4,099,095

[45] Jul. 4, 1978

[54] OPERATING CIRCUIT FOR GASEOUS DISCHARGE AND INCANDESCENT LAMPS

[75] Inventor: Charlie B. Turner, Hendersonville, N.C.

[73] Assignee: General Electric Company, N.Y.

[21] Appl. No.: 661,226

[22] Filed: Feb. 25, 1976

[51] Int. Cl.[2] ..... H05B 41/46

[52] U.S. Cl. ..... 315/92; 315/87; 315/136

[58] Field of Search ..... 315/88, 90, 91, 92, 315/93, 121, 130, 131, 136, 322, 87; 307/38, 41

[56] References Cited

U.S. PATENT DOCUMENTS

| | | | |
|---|---|---|---|
| 3,517,254 | 6/1970 | McNamara, Jr. | 315/91 |
| 3,611,432 | 10/1971 | Babcock et al. | 315/92 |
| 3,699,382 | 10/1972 | Franke | 315/92 |
| 3,737,719 | 6/1973 | Nodurft | 315/91 |
| 3,927,348 | 12/1975 | Zawadzki | 315/88 |

*Primary Examiner*—Eugene R. LaRoche
*Attorney, Agent, or Firm*—Sidney Greenberg

[57] ABSTRACT

Gaseous discharge lamp is connected to a current sensing transformer which generates a signal when the lamp is on to turn on a triac operating a relay for turning off an auxiliary incandescent lamp which automatically operates when the gaseous discharge lamp is extinguished. A time delay circuit including a temperature-sensitive resistor is connected to the triac for keeping the auxiliary lamp in operation until the gaseous discharge lamp reaches a suitable light level.

11 Claims, 2 Drawing Figures

OPERATING CIRCUIT FOR GASEOUS DISCHARGE AND INCANDESCENT LAMPS

The present invention relates to gaseous discharge lamp operating circuits and more particularly to such circuits incorporating an auxiliary lighting feature.

It is an object of the invention to provide an improved auxiliary lighting circuit for use with gaseous discharge lamp operating circuits.

It is a particular object of the invention to provide an auxiliary lighting circuit of the above type which may be employed with various types of gaseous discharge lamps and ballasts used in conjunction therewith.

Still another object of the invention is to provide an auxiliary lighting circuit of the above type adapted for use with high voltage starting circuits for igniting high intensity discharge lamps.

A further object of the invention is to provide an auxiliary lighting circuit of the above type wherein the auxiliary light source is maintained in operation until the main light source reaches operating brightness.

Other objects and advantages will become apparent from the following description and the appended claims.

With the above objects in view, the present invention, in one of its aspects, relates to a lighting system comprising a source of alternating current, a gaseous discharge lamp connected to the source, ballast means connected to the source including impedance means connected in series with the gaseous discharge lamp, a current sensing transformer having a primary winding in series with the gaseous discharge lamp and having a secondary winding, an incandescent lamp, means for connecting the incandescent lamp to a source of current, actuating means connected to the secondary winding of the current sensing transformer and to the incandescent lamp for rendering the incandescent lamp inoperative during operation of the gaseous discharge lamp and for automatically rendering the incandescent lamp operative when the gaseous discharge lamp ceases operation, and time delay means connected to the actuating means for delaying turning off of the incandescent lamp for a predetermined period after reignition of the gaseous discharge lamp.

Figure 1:
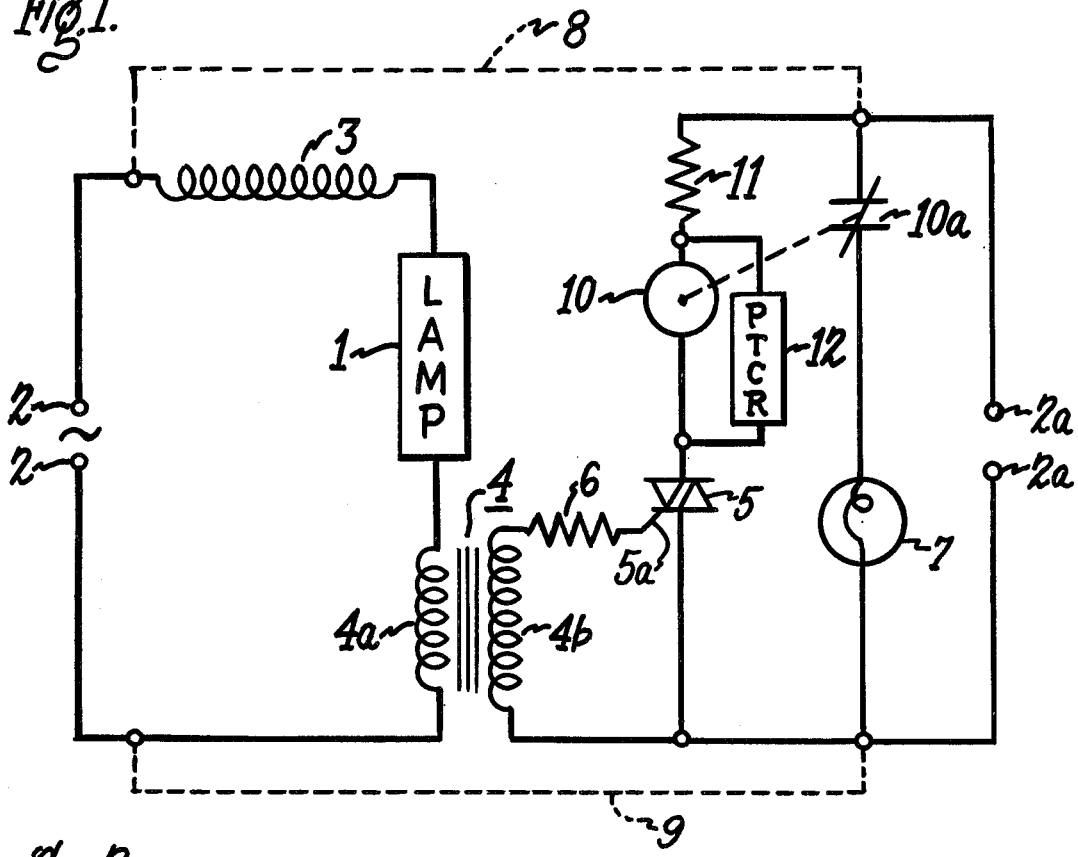
Figure 2:
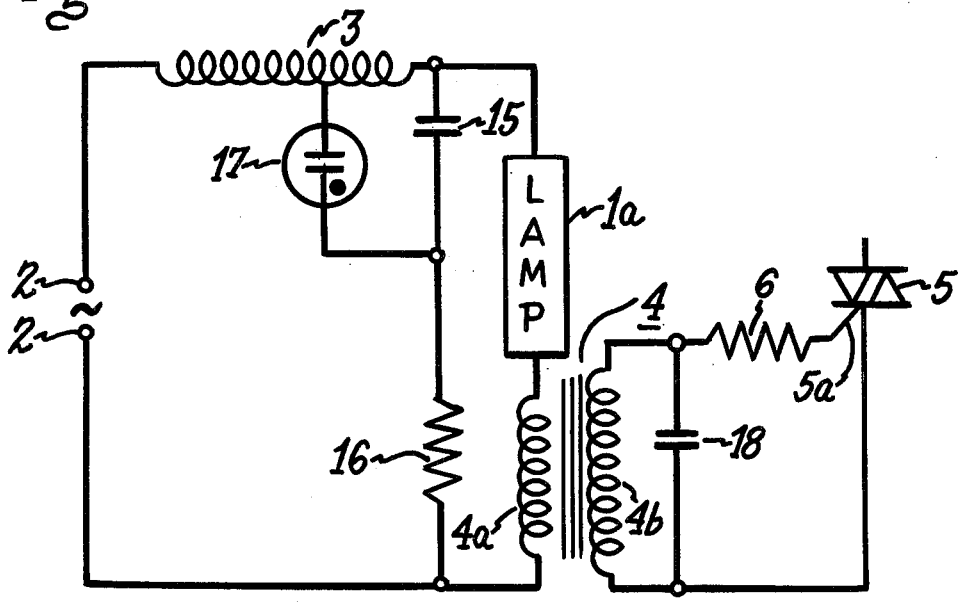

The invention will be better understood from the following description taken in conjunction with the accompanying drawing, in which:

FIG. 1 is a circuit diagram of an embodiment of the invention, including a ballast comprising an inductive reactance for operating a gaseous discharge lamp; and FIG. 2 is a circuit diagram showing a modification of the FIG. 1 circuit including a starting circuit associated with the ballast for igniting the gaseous discharge lamp.

Referring now to the drawing, and particularly to FIGURE 1, there is shown an operating circuit for a gaseous discharge lamp 1, such as a mercury vapor lamp, connected to terminals 2 of a source of alternating current in series with a ballast comprising an induction coil 3 which provides a linear reactance. When gaseous discharge lamp 1 is energized by the alternating current source, reactor 3 serves as a ballast to limit the amount of current that can be drawn by the lamp, as conventional in the art. During operation of discharge lamp 1, current flows through the lamp, whereas no current flows where lamp 1 is extinguished. When lamp 1 goes out due to interruption of supply current or a drop in voltage across the line, or other causes, the lamp will not reignite until it has cooled off, even after normal supply current has been restored. As a result, the light from one or more luminaires using such gaseous discharge lamps and operated from the same electrical supply system may suddenly fail due to a transient fault in the system, and darkness will prevail for the several minutes necessary to allow the discharge lamps to cool sufficiently to permit reignition.

While auxiliary lighting circuits are known which are automatically turned on when the main discharge lamp goes out, the prior systems have had certain disadvantages, such as not being universally adaptable to various types of discharge lamps or various forms of ballasts used for operating the discharge lamps, or being subject to false actuation of the auxiliary lighting circuit, or other difficulties.

These and other disadvantages are overcome in accordance with the present invention, wherein a current transformer 4 is employed for sensing current flowing through discharge lamp 1 and serving in response thereto to actuate an auxiliary lighting system, as more fully described below. In the embodiment illustrated in FIG. 1, primary winding **4*a* of current sensing transformer 4 is connected in series with lamp 1. Secondary winding 4*b* of the transformer is connected at one side, via current limiting resistor 6, to the gate (control) electrode 5*a* of triac 5, which is an alternating current semiconductor controlled switch having a single control electrode which, when gated, causes the switch to conduct current in the direction as indicated by the forward bias condition of the semiconductor. Connected across triac 5 is the auxiliary lighting source comprising incandescent lamp 7 which may be connected to terminals 2*a*, 2*a* of an independent electrical supply source or connected to terminals 2, 2 of the above-mentioned alternating current source by leads 8, 9** shown in interrupted lines.

Connected across incandescent lamp 7 in series with triac 5 is relay coil 10 having relay switch contacts **10*a* in series with lamp 7. Resistor 11 is connected in series with relay coil 10, and temperature-sensitive resistor 12 (thermistor) is connected across relay coil 10 and serves in conjunction with resistor 11 to provide a predetermined delay in the turn-off of incandescent lamp 7. As well understood in the art, thermistor 12** has a positive temperature coefficient (PTC) whereby it increases in resistance with an increase in temperature. The thermistor is accordingly referred to herein as a PTCR.

In the operation of the described circuit, when discharge lamp 1 is operating, current flows through primary winding **4*a* of current sensing transformer 4 so that the resulting voltage across the transformer secondary winding 4*b* actuates and turns on triac 5, causing relay coil 10 to be energized and opening normally closed relay contacts 10*a*. Incandescent lamp 7 accordingly does not operate under these conditions while main discharge lamp 1** is on.

When discharge lamp 1 is extinguished for any reason, current does not flow through current sensing transformer winding **4*a* and therefore the transformer does not generate a signal to turn on triac 5. Relay 10 is de-energized and as a result incandescent lamp 7 is energized through normally closed relay contacts 10*a*. After a sufficient period has elapsed for discharge lamp 1 to cool off, it is re-ignited by the supply voltage. Transformer 4 then senses the flow of current through the discharge lamp circuit and turns on triac 5. Relay contacts 10*a*** do not open immediately because PTCR 12 in shunt with relay coil 10 is in its low resistance state and, as a result, insufficient current passes through the relay coil to operate its contacts. As PTCR 12 heats sufficiently to change to a high resistance condition, sufficient current flows through relay coil 10 to open its contacts 10*a* and thereby turn off incandescent lamp 7. By this time, discharge lamp 1 has reached full operating brightness. The amount of time delay is readily adjusted by suitable selection of resistor 11, which in conjunction with PTCR 12 forms a voltage divider to determine the warmup time of the PTCR and, hence, the time delay before incandescent lamp 7 is turned off.

The use of a current sensing transformer in accordance with the invention makes the described auxiliary lighting system adaptable to various types of gaseous discharge lamps and different types of electrical ballasts used with such lamps. Hence, while the described embodiment incorporates a ballast comprising inductive linear reactor 3, it will be understood that other forms of ballasts may be employed, such as an isolation transformer, autotransformer, regulator ballast, and other types.

In the case where the gaseous discharge lamp is of the type requiring a high starting voltage for ignition, such as high pressure sodium vapor lamps, it is desirable to provide means in the auxiliary lighting circuit to prevent false turn-on of triac 5, with resulting premature turn-off of incandescent lamp 7, due to the pulses generated in the high voltage starting circuit. FIG. 2 shows such an arrangement, wherein a high voltage pulse generator of known type is provided comprising capacitor 15 and resistor 16 connected in series across lamp 1*a* on the output side of reactor 3, and a voltage sensitive symmetrical switch 17, such as a neon glow lamp. Switch 17 may be of other forms such as a triac or other semiconductor controlled switch device which becomes conductive upon application of a predetermined voltage thereon. As shown, switch 17 is connected across capacitor 15 and a predetermined number of turns of reactor ballast 3 at the output end thereof, so that switch 17 is in series discharge relation with capacitor 15 and the tapped turns of ballast 3 in series therewith. The operation of the described starting circuit is such that capacitor 15 is initially charged through resistor 16 by the input voltage from the alternating current source, and when the voltage on capacitor 15 reaches the breakdown voltage of switch 17, the capacitor discharges through the tapped turns of ballast 3, thereby producing high voltage pulses for starting lamp 1*a*. Upon starting of lamp 1*a*, the pulsing mechanism is disabled as a result of the voltage clamping action of the ignited lamp load, and therefore the voltage buildup across capacitor 15 does not reach the breakdown level of switch 17.

To prevent such starting pulses from prematurely actuating triac 5, capacitor 18 is connected across the secondary winding of transformer 4 as shown in FIG. 2 and functions thereby as a by-pass capacitor to avoid unintended actuation of the triac.

The remaining portion of the FIG. 2 auxiliary lighting circuit which is omitted is the same as that of FIG. 1.

The current sensing transformer is preferably such as to be compatible with lamp operating currents in the range of 0.8 to 6 amperes and to have an output voltage of about 2½ volts for application to triac 5. A transformer having such properties may have the following typical construction: The core of the transformer is made of ferrite material with an E-I configuration. The body length of the core is 30 mm. and has an air gap of 0.1 mm. A primary coil consisting of 15 turns of AWG 18 wire and a secondary coil consisting of 300 turns of AWG 31 wire are wound on a common bobbin with a layer of insulating tape between the primary and secondary windings.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. Lighting system comprising, in combination, a source of alternating current, a gaseous discharge lamp connected to said source, ballast means connected to said source including impedance means connected in series with said gaseous discharge lamp, a current sensing transformer having a primary winding in series with said gaseous discharge lamp and having a secondary winding, an incandescent lamp, means for connecting said incandescent lamp to a current source, and actuating means connected to the secondary winding of said current sensing transformer and to said incandescent lamp for rendering said incandescent lamp inoperative during operation of said gaseous discharge lamp and for automatically rendering said incandescent lamp operative when said gaseous discharge lamp ceases operation, said actuating means comprising controlled switch means in parallel with said incandescent lamp and having a control electrode connected to said secondary winding for actuation thereby for controlling the operation of said incandescent lamp.

2. A system as defined in claim 1, and time delay means connected to said actuating means for delaying turning off of said incandescent lamp for a predetermined period after re-ignition of said gaseous discharge lamp.

3. A system as defined in claim 2, said actuating means including relay means having a coil connected in series with said controlled switch means and switch contacts connected in series with said incandescent lamp, said switch contacts being open when said relay coil is energized and closed when said relay coil is de-energized.

4. A system as defined in claim 3, said time delay means comprising temperature-sensitive resistor means having a positive temperature coefficient connected across said relay coil.

5. A system as defined in claim 4, and a resistor connected in series with said relay coil and said temperature-sensitive resistor means for controlling the time of said predetermined period.

6. A system as defined in claim 1, said impedance means comprising an induction coil.

7. A system as defined in claim 6, and high voltage starting means connected to said induction coil for providing high voltage starting pulses on said gaseous discharge lamp, and by-pass capacitor means connected across said secondary winding for preventing actuation of said actuating means by said starting pulses.

8. A system as defined in claim 1, said controlled switch means comprising a triac.

9. A system as defined in claim 1, said actuating means including relay means having a coil connected in series with said controlled switch means and switch contacts connected in series with said incandescent lamp, said switch contacts being open when said relay coil is energized and closed when said relay coil is de-energized.

10. A system as defined in claim 1, said control electrode being connected to said secondary winding by a permanently conductive path for being directly responsive to the voltage across said secondary winding.

11. A system as defined in claim 1, said controlled switch means being a semiconductor.

* * * * *